US011840872B1

(12) United States Patent
Ben David

(10) Patent No.: US 11,840,872 B1
(45) Date of Patent: Dec. 12, 2023

(54) NON-HINGED DOOR SYSTEM AND METHOD OF CONVERSION OF A HINGED DOOR INTO A NON-HINGED DOOR

(71) Applicant: Roy Ben David, Silver Spring, MD (US)

(72) Inventor: Roy Ben David, Silver Spring, MD (US)

( * ) Notice: Subject to any disclaimer, the term of this patent is extended or adjusted under 35 U.S.C. 154(b) by 125 days.

(21) Appl. No.: 17/167,205

(22) Filed: Feb. 4, 2021

(51) Int. Cl.
*E05D 15/06* (2006.01)
*E05D 15/10* (2006.01)
*E05D 15/56* (2006.01)

(52) U.S. Cl.
CPC ..... *E05D 15/1021* (2013.01); *E05D 15/1005* (2013.01); *E05D 15/1042* (2013.01); *E05D 15/565* (2013.01); *E05D 2015/1055* (2013.01); *E05Y 2201/684* (2013.01); *E05Y 2201/688* (2013.01)

(58) Field of Classification Search
CPC ..... E05D 15/1021; E05D 15/1005; E05D 15/1042; E05D 15/565; E05D 2015/1055; E05Y 2201/684; E05Y 2201/688
USPC ..... 49/209, 218, 219
See application file for complete search history.

(56) References Cited

U.S. PATENT DOCUMENTS 1,889,122 A 11/1932 Hewitt
2,571,215 A * 10/1951 Dath ..... B61D 19/008 49/215
3,006,040 A * 10/1961 Madland ..... B61D 19/009 49/219
3,611,637 A * 10/1971 Saino ..... E05D 15/1021 49/235
4,329,917 A * 5/1982 Fisher ..... B60H 1/262 16/337
4,404,770 A * 9/1983 Markus ..... E05F 5/003 49/235
4,453,752 A * 6/1984 McKann ..... E05B 15/024 D8/344

(Continued)

FOREIGN PATENT DOCUMENTS

WO WO-2007141314 A2 * 12/2007 ..... B60J 1/14

OTHER PUBLICATIONS

Sliding Door Hinge Assembly Refresh FAQ. https://www.thesamba.com/vw/forum/viewtopic.php?t=446358 Accessed Dec. 4, 2019, 20 pages.

*Primary Examiner* — Jerry E Redman
(74) *Attorney, Agent, or Firm* — Pearne & Gordon LLP

(57) ABSTRACT

A door system is provided for use with a door and a door frame defining an entry opening to provide selective closing and opening of the entry opening. The door system can be used to convert a conventional hinged door into one providing less obtrusion into space in front of and behind the respective entry opening. The door system includes an overhead movement mechanism providing at least two transverse directions of movement, and one or more hinge replacement mechanisms providing latching of the door at a lateral side opposite the door handle. The movement mechanism is configured to move the door between a closed orientation in the door frame and an open orientation horizontally spaced from the entry opening. The open orientation is disposed along an adjacent wall having the door frame. A standard door handle, strike and strike plate are used to move and to lock the door.

14 Claims, 8 Drawing Sheets

(56) References Cited

U.S. PATENT DOCUMENTS 4,476,652 A * 10/1984 Beauchot ..... E05D 15/063 16/98
4,513,554 A * 4/1985 Johnson ..... E06B 3/721 49/404
4,619,074 A 10/1986 Leung et al.
4,651,469 A * 3/1987 Ngian ..... E05D 15/1021 49/411
4,680,828 A * 7/1987 Cook ..... E05D 15/0634 16/102
4,688,352 A * 8/1987 Kinoshita ..... E05D 15/10 49/209
4,991,257 A 2/1991 Eutebach
5,272,838 A 12/1993 Gibbs
5,301,468 A * 4/1994 Kamezaki ..... E05D 15/1021 49/225
5,351,442 A * 10/1994 Gingras ..... E06B 1/32 49/411
5,461,829 A 10/1995 Lehto et al.
5,566,505 A * 10/1996 Kamezaki ..... E05D 15/1021 49/225
5,613,718 A * 3/1997 Lin ..... E05B 17/2003 292/341.15
5,884,683 A 3/1999 Sears
6,082,790 A * 7/2000 Mossotti ..... E05B 17/005 292/289
6,098,341 A * 8/2000 Gebauer ..... E05F 15/652 49/362
6,497,072 B2 * 12/2002 Fries ..... E05B 65/08 49/213
6,611,990 B1 9/2003 Sogo et al.
6,698,807 B1 * 3/2004 Wacker ..... E05B 17/005 292/341.14
6,826,867 B1 * 12/2004 McDonald ..... E05D 15/1042 49/213
6,912,812 B2 7/2005 Inage
7,422,249 B2 * 9/2008 Glover ..... E05B 65/0811 292/199
7,552,561 B2 * 6/2009 Schneckenleitner . E05F 15/655 105/337
7,610,718 B2 * 11/2009 Kopish ..... E05D 15/1042 49/211
7,950,439 B2 5/2011 Anderson
8,112,954 B2 * 2/2012 Gosling ..... E05C 17/60 52/211
8,375,645 B2 * 2/2013 Iwauchi ..... E05D 15/1042 49/213
8,904,713 B1 * 12/2014 Anderson ..... E05B 17/2084 49/460
8,984,810 B2 * 3/2015 Bortoluzzi ..... E05D 15/1042 49/213
9,016,736 B1 * 4/2015 Anderson ..... E05B 15/0205 292/288
9,470,028 B2 * 10/2016 Header ..... E05D 15/0652
9,476,222 B1 * 10/2016 Johnson ..... E05B 15/0205
10,626,648 B2 * 4/2020 Sakabe ..... E06B 3/4645
10,801,241 B1 * 10/2020 Dixon ..... E05F 1/105
11,156,028 B1 * 10/2021 Moeller ..... E05D 15/063
2006/0225356 A1 * 10/2006 Jarolim ..... E05D 11/00 49/218

* cited by examiner

NON-HINGED DOOR SYSTEM AND METHOD OF CONVERSION OF A HINGED DOOR INTO A NON-HINGED DOOR

FIELD OF THE INVENTION

The subject application relates to a non-hinged door system for selectively opening and closing an entry opening of a building and also to a door system and method for converting a hinged door into a non-hinged door.

BACKGROUND

Nearly every conventional building today includes one or more doors for allowing selective opening and closing of entry openings or openings to rooms, hallways, storage areas, etc. These doors typically are hinged doors, having two or more hinges, thus allowing the respective door to pivot about hinge pins of the hinges disposed at one side of the door. In this way, the door swings out of a respective door frame in at least one of two directions. Double-hinged doors allow for these doors to swing or pivot in both directions, both away from and towards a user.

Recently, pocket door systems and barn door systems are becoming increasingly desired in the construction of both residential and commercial buildings.

A pocket door system is one having a door that is slidingly mounted for translation into and out of a portion of a wall, and particularly a non-bearing portion of a wall. The pocket door translates in a direction along the lateral width of the pocket door into a pocket within the wall. This type of door is typically mounted prior to installation of drywall or other wall covering materials and requires a pocket to be formed within the framing of the respective wall. The pocket door can then be selectively translated into and out of a door frame without outwardly pivoting from the door frame.

A pocket door, however, is not particularly suited to being installed after initial construction of a wall or respective room or hallway. That is, it is common for buildings to be built for one purpose, or for one owner and then later to be used for a different purpose or sold to a new owner. After the initial construction, where a pocket door is not initially included prior to the finishing of a wall or respective room or hallway, later installation of such pocket door can be difficult. The conversion often can require nearly complete demolition of the respective wall at which the pocket is to be later formed. In some cases, this can also require moving load-bearing supports to accommodate the pocket being formed.

Barn doors are increasingly used in residential dwellings and commercial buildings, such as those having retail sales shops. A so-called barn door system gets its name from the sliding doors often associated with entry and closing of a large barn or stable space, where one or more doors slide along one or more respective rails. The doors are not engaged specifically within a door frame, but rather are typically hung from a wall above an entry opening or other opening at a position spaced outwardly from the door frame. The doors translate adjacent the opening and wall forming the opening, between positions generally blocking and laterally-spaced from the opening. That is, a respective door is slidingly mounted to a rail, which rail extends along the full width of the opening to be closed by the door, and also along at least a further distance to one side of the opening. This further distance is typically at least equal to the width of the door itself. In this way, the door can be translated from a closed orientation in front of the opening, to an open orientation disposed lateral to (to the side of) the opening. In the open position, the barn door typically is not covering any of the opening.

BRIEF SUMMARY

As an alternative to the aforementioned pocket doors or barn doors, the present disclosure provides embodiments of non-hinged door systems that address drawbacks of such pocket doors and barn doors. Embodiments of the doors system of the present disclosure are installable at initial construction or are usable as a conversion system for an existing hinged door without significant custom modifications to the existing door or door frame. Indeed, in some embodiments, no modification to the existing door or door frame are required.

For example, a door system is provided for use with a door and a door frame defining an entry opening to provide selective closing and opening of the entry opening with the door. The door system can be used to convert a conventional hinged door into one providing less obtrusion into space in front of and behind the respective entry opening. The door system includes an overhead movement mechanism providing at least two transverse directions of movement, and one or more hinge replacement mechanisms providing latching of the door at a lateral side opposite the door handle. The movement mechanism is configured to move the door between a closed orientation in the door frame and an open orientation horizontally-spaced from the entry opening. The open orientation is disposed along an adjacent wall having the door frame. A standard door handle, strike and strike plate are used to move and to lock the door.

According to one aspect, a door system is provided for use with a door and a door frame defining an entry opening to provide selective closing and opening of the entry opening. The door system includes a movement mechanism couplable to the door for supporting the door relative to the entry opening. The movement mechanism is configured to guide the door relative to the entry opening along at least a pair of transverse directions to slide the door out of the entry opening and to translate the door along the wall having the entry opening. The door system further includes a latching mechanism for retaining the door within the entry opening, where the latching mechanism is couplable to the door frame and to one lateral side of the door, and where the latching mechanism is configured to stabilize the door within the entry opening against further movement along the pair of transverse directions.

According to another aspect, a door conversion system is provided for converting a hinged door into a non-hinged door. The door system includes a movement mechanism providing at least two transverse directions of movement and couplable at a door to-be-converted, and a hinge replacement mechanism for being coupled to a first lateral side of the door. The first lateral side is opposite a second lateral side of the door adjacent a door handle. The hinge replacement mechanism is configured to latch the first lateral side of the door within a respective door frame. The movement mechanism is configured to couple to a wall having the door frame, where the movement mechanism is configured to enable selective translation of the door into and out of the door frame with the door being aligned parallel to the wall having the door frame. The movement mechanism further is configured to enable selective translation of the door along the wall having the door frame while retaining the door aligned parallel to said wall.

According to yet another aspect, a method is provided for converting a hinged door into a non-hinged door. The method includes: (a) removing the hinged door and removing the hinge plates from each of the door and the respective door frame; (b) retaining an existing handle on the door; (c) coupling a first latch plate of a pair of corresponding latch plates at a lateral side of the door opposite the existing door handle, and at a location of the lateral side corresponding to the respective removed hinge plate; (d) coupling a second latch plate of the pair of corresponding latch plates at a location of the door frame corresponding to the respective removed hinge plate; (e) coupling a support of a movement mechanism to the door; (f) mounting the support for translation along the door frame along a first direction; and (g) operating the moving mechanism to move the door relative to the door frame along a second direction that is transverse to the first direction.

The foregoing and other features of the invention are hereinafter described in greater detail with reference to the accompanying drawings.

BRIEF DESCRIPTION OF THE DRAWINGS

The accompanying drawings, which are not necessarily to scale, show various aspects of the disclosure.

DETAILED DESCRIPTION

The present disclosure is generally directed to non-hinged doors and more particularly directed to door systems for providing movement of a non-hinged door into and out of a door frame. The present disclosure also is directed to door systems for conversion of a hinged door to a non-hinged door, and to a method for the conversion of a hinged door into a non-hinged door.

The embodiments of door systems described herein are usable for providing selective opening and closing of a space having an entry opening to said space, such as through a door frame. the embodiments of the door systems can also be used in instances where a typical door frame—jamb and casing—is not present, but where an entry opening is defined. The door systems can be used for rooms, hallways, closets, stairway entries, etc.

Different from the aforementioned conventional pocket door systems and barn door systems, the non-hinged door systems described herein can be used in a situation requiring increased usable space, such as in smaller rooms, hallways or entry openings, wherein it is difficult to maintain an obstructed swing path of a hinged door, or where a non-bearing wall is not obtainable for a pocket door system, while still providing secure latching of the door. That is, a conventional barn door has a greater height and width than the opening the barn door is covering, to prevent gaps from being provided between the outer periphery of the door and the inner periphery of the opening. This is because a barn door hangs in front of the wall forming the entry opening, rather than within the entry opening itself. Conversely, the door systems of the present disclosure are particularly configured to latch within a door frame to provide security and privacy to the user. No custom lock solution is required. Accordingly, the door systems described herein are suitable for use with rooms requiring privacy, such as changing rooms, bathrooms, walk-in closets, bedrooms, offices, etc.

As a conversion system for an existing door, these non-hinged door systems allow for use of the exact door from the hinged door system being replaced, and for said door to maintain a secure closure within the existing door frame when in a closed orientation. The non-hinged door systems are configured for conversion-use in locations where the swing path of a hinged door is difficult to maintain in an unobstructed state, allowing the user to retake this space for alternative use unrelated to the opening of the door.

Figure 1:
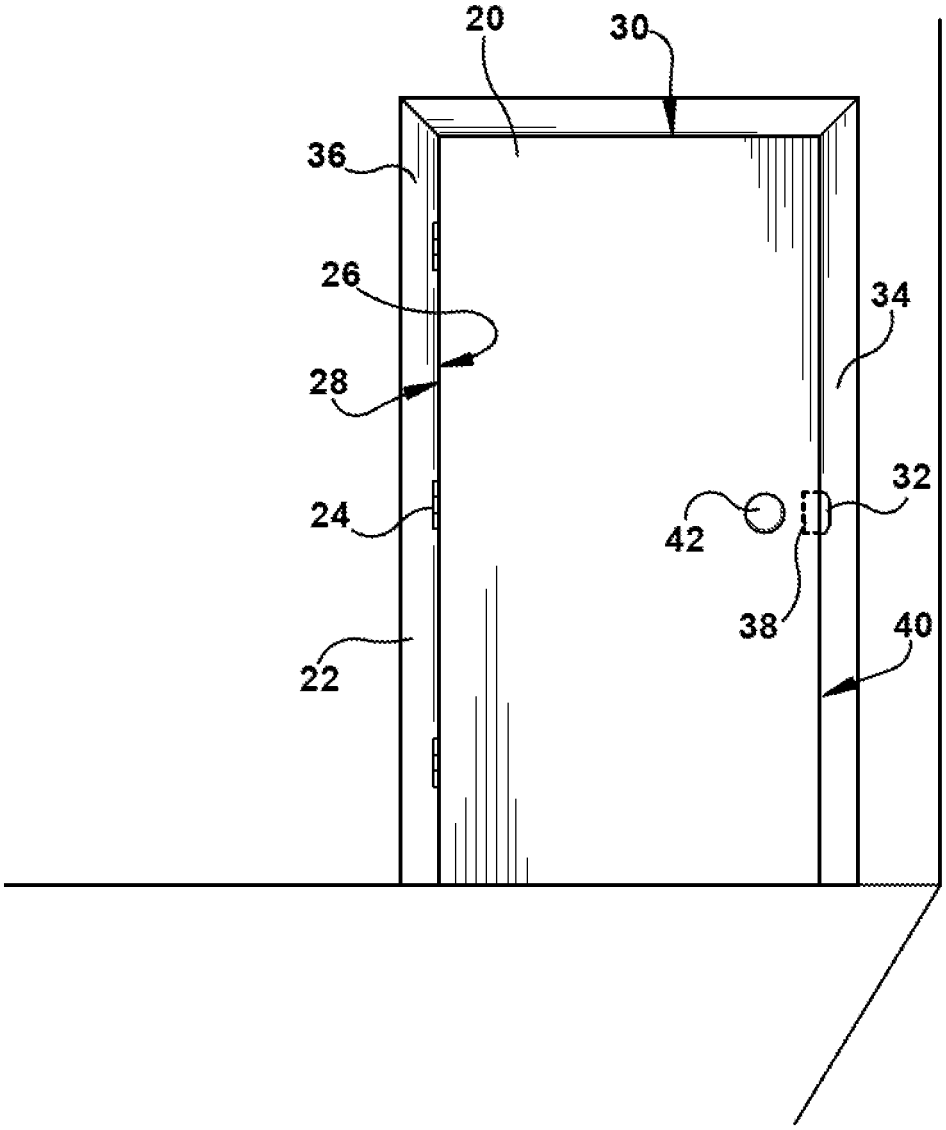
FIG. 1 (Prior Art)
FIG. 1 is a front view of a conventional hinged door latched in a door frame.

Turning first to FIG. 1, a conventional hinged door 20 is illustrated for purposes of identifying conventional aspects of this type of door. The door 20 is coupled to a door frame 22 by a set of hinges 24. The hinges 24 each include a pair of hinge plates, with one plate being coupled to the door jamb 26 and with the other plate being coupled to a first lateral side 28 of the door 20. The door jamb 26, and thus the door frame 22, defines an entry opening 30 through the door frame 22 that is selectively opened and closed via pivoting of the door 20 relative to the door frame 22 via support of the hinges 24. A strike plate 32 is coupled to a strike side 34 of the door frame 22, opposite the hinge side 36. A strike 38 at a second lateral side 40 of the door 20 engages the strike plate 32 to latch the door 20 within the door frame 22. The strike 38 is biased into a default position of engagement with the strike plate 32. Operation of the door handle 42 translates the strike 38 out of engagement with the strike plate 32, to allow for unlatching of the door 20 from the door frame 22. As used herein, the door handle 42 can include a knob, a pivotable handle, or other element that is operatable by the user to move the associated strike 38.

Figure 2:
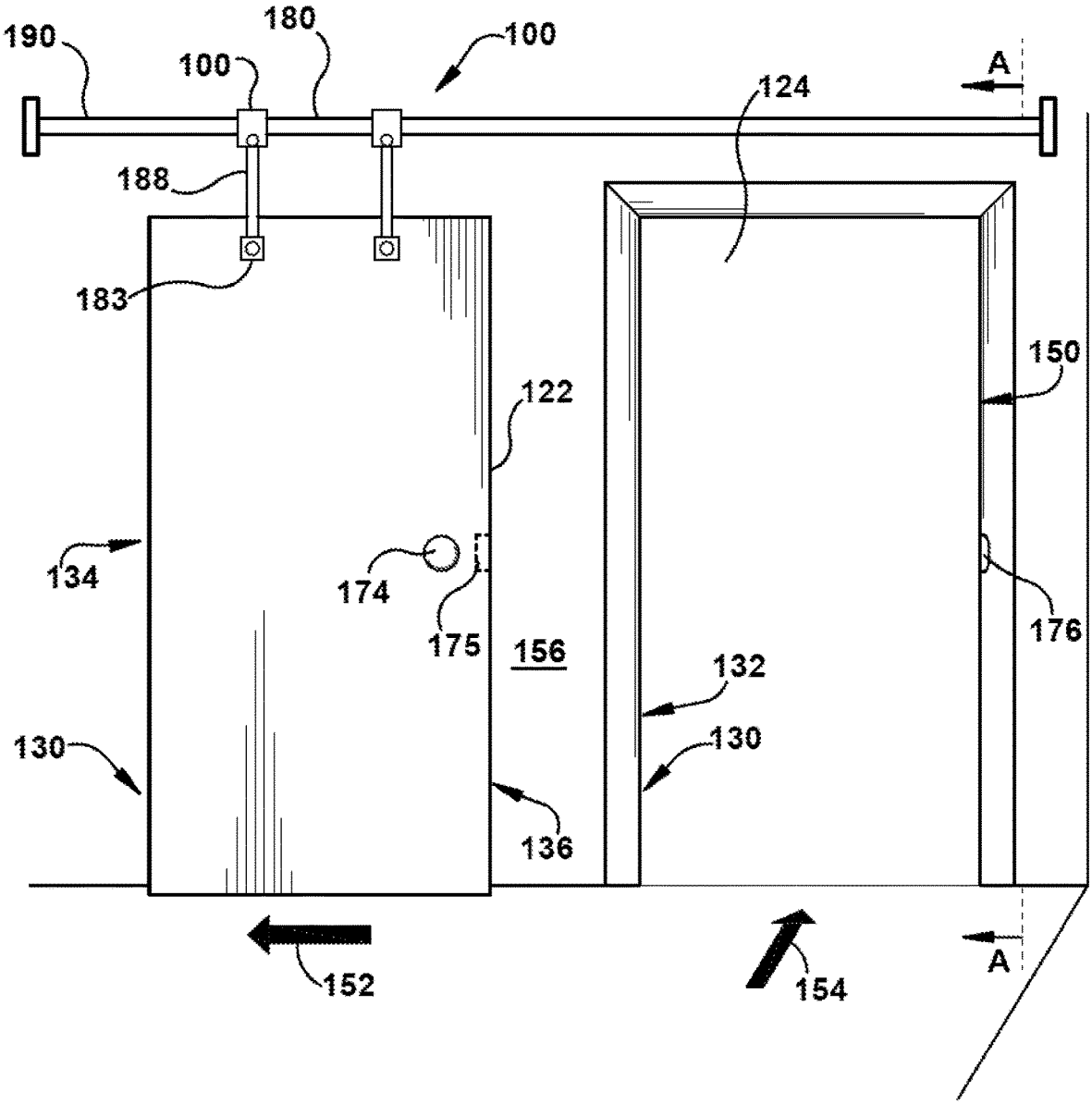
FIG. 2 is a front view of a non-hinged door system according to the subject application, in combination with a conventional door and door frame.

Turning now to FIG. 2, a first embodiment of a door system according to the present disclosure will be described in detail. The door system 100 includes aspects that are suitable for use with the door 120 and the door frame 122 to support and guide the door 120 for movement relative to, and particularly into and out of, the door frame 122. The door system 100 more specifically includes a latching mechanism 130 and a movement mechanism 180 for allowing selective closing and opening of the entry opening 150 defined by the door frame 122.

Figure 4:
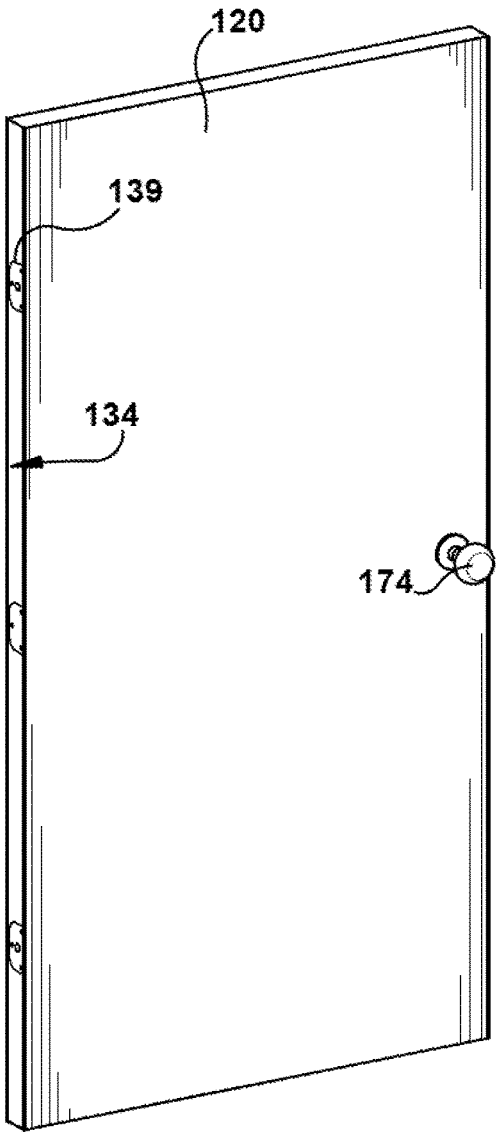
FIG. 4 is a front perspective view of the door of FIG. 2, with the door having latch plates according to the subject application.
Figure 3:
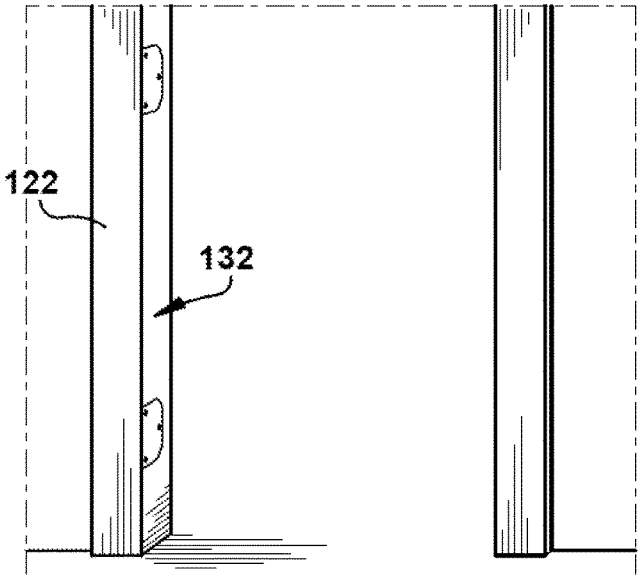
FIG. 3 is a partial perspective view of the door frame of FIG. 2, showing the hinge-side of the door jamb with the hinge plates removed from the doorjamb.
Figure 8A:
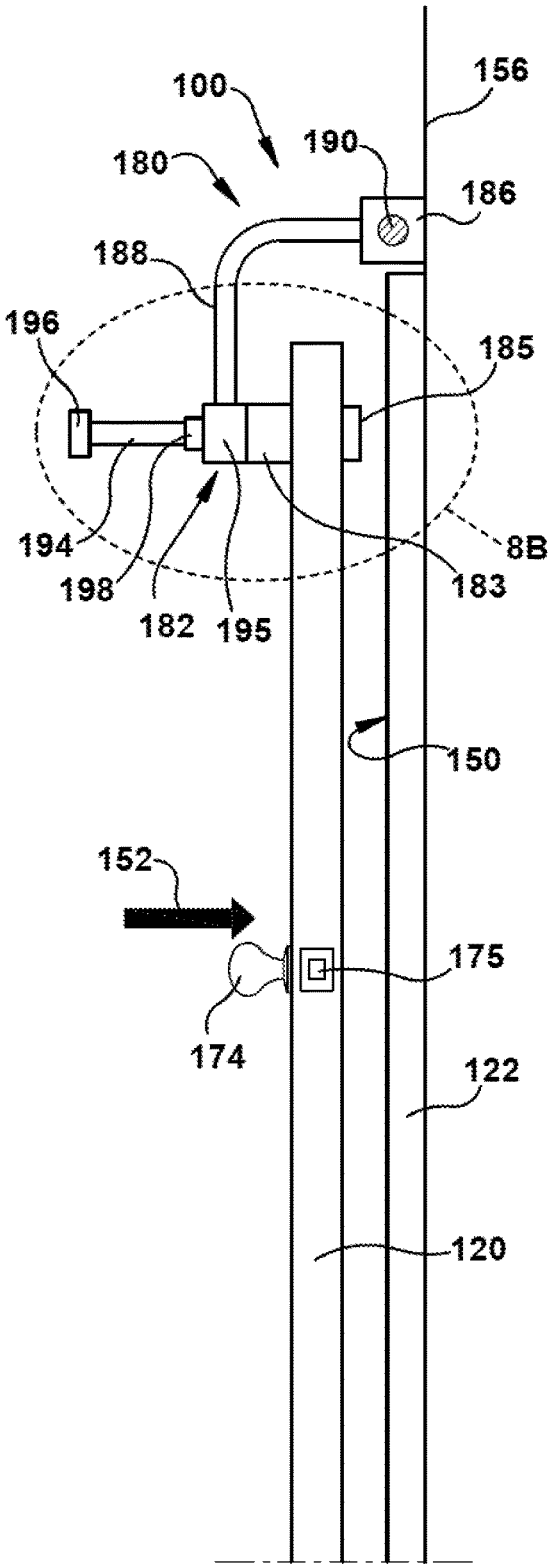
FIG. 8A is a side view of the door system of FIG. 2, shown along the line A-A of FIG. 2.

Turning to FIGS. 2 to 4 and the latching mechanism 130, this mechanism is configured to retain the door 120 within the entry opening 150 and to stabilize the door 120 within the entry opening 150 against further movement along a pair of transverse directions 152 (FIG. 2) and 154 (FIG. 8A). The first direction 152 is a lateral direction along a width of the door between its opposite lateral sides 134 and 136. The second direction 154 is aligned along a thickness of the door 120. The two directions 152 and 154 are transverse to one another, and particularly are generally set orthogonally to one another. In some embodiments, the two directions 152 and 154 can intersect one another. That is, the latching mechanism 130 is configured to latch the door 120 against lateral side to side movement and movement into and out of the entry opening 150.

Figure 5:
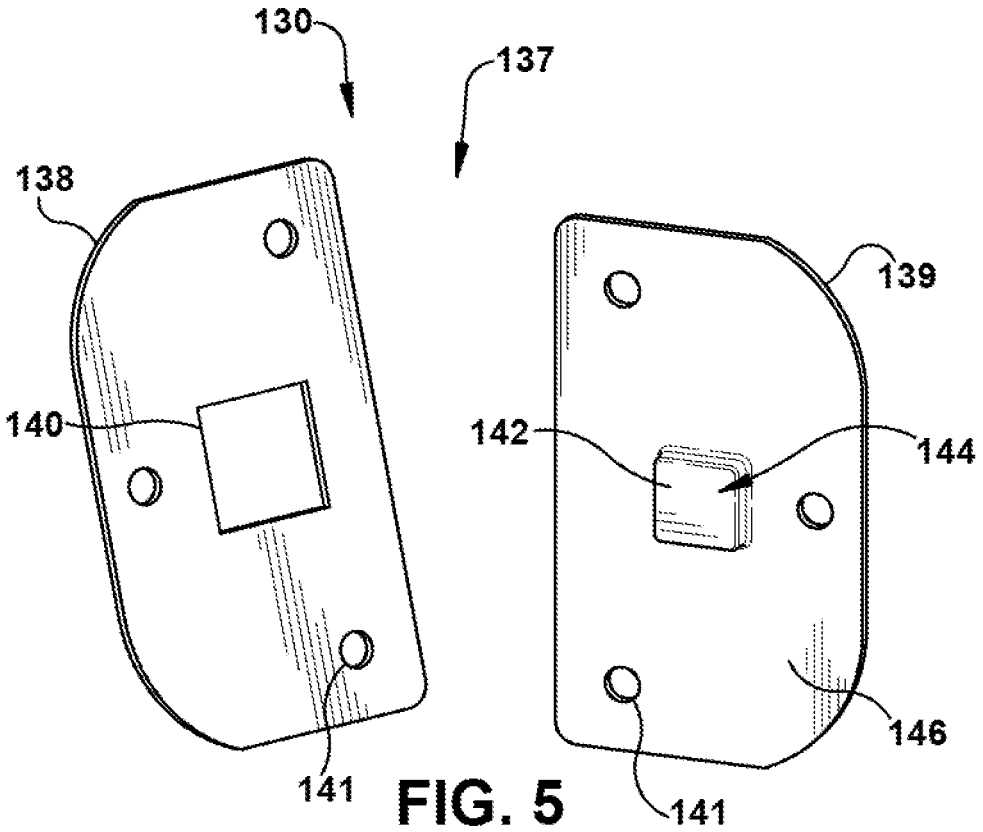
FIG. 5 depicts a pair of corresponding latch plates including a latch plate depicted in FIG. 2.

Turning to FIG. 5, along with FIGS. 2, the latching mechanism 130 is couplable to a hinge side 132 of the door frame 122, shown at FIG. 3, and to the first lateral side 134 of the door 120, shown at FIG. 4. The illustrated latching mechanism 130 includes at least one pair, and preferably at least two pairs 137, of corresponding latch plates 138, 139. The pairs 137 are vertically-spaced apart from one another along the hinge side 132 and first lateral side 134. The latch plates 138, 139 can be formed from any suitable material, such as a suitable plastic or metal. A material of one latch plate 138, 139 can be different from a material of the other latch plate 138, 139.

A first latch plate 138 of each pair 137 is couplable to the hinge side 132, while a second latch plate 139 of each pair 137 is couplable to the first lateral side 134. The locations of the latch plate 138 corresponds to the location of the latch plate 139 to allow for the latch plates 138 and 139 to slidably engage and to couple to one another when the door 120 is moved into the entry opening 150. More particularly, the locations of the latch plates 138 and 139 correspond to industry standard hinge locations of the door 120 and of the door frame 122. That is, the latch mechanism 130 serves as a hinge replacement mechanism.

Particularly, the latch plates 138 and 139 have outer peripheries that are similar to one another and that define shapes similar to that of conventional hinge plates. The latch plates 138 and 139 also have fastener holes 141 arranged in a layout of that of conventional hinge plates. In this way, conversion of a hinged door to a non-hinged door using the door system 100 does not require significant, and in some cases does not require any, additional coring or removal of material from the door 120 and door frame 122.

Turning specifically to FIG. 5, the latch plates 138 and 139 are illustrated side-by-side. Generally, this latch mechanism 130 includes key and hole features. The first latch plate 138 includes a cut-out 140 generally centrally-located at the first latch plate 138. The cut-out 140 extends fully through the first latch plate 138. In some embodiments, the cut-out 140 can extend less than fully through the first latch plate 138 or can be replaced by a detent.

The second latch plate 139 includes a raised projection 142 that is configured to be received into the cut-out 140 of the first latch plate 138. That is, the first and second latch plates 138, 139 are of the same size, and the raised projection 142 is generally centrally-located on the latch plate 139, similar to the location of the cut-out 140 at the first latch plate 138.

The depicted raised projection 142 is a stamped or molded projection, depending on the material of the second latch plate 139. That is, the raised projection 142 is integral with a main body 146, and together the raised projection 142 and main body 146 are a unitary body. The raised projection 142 has a top surface 144 that is outwardly-spaced from the main body 146 of the second latch plate 139.

In some embodiments, the raised projection 142 can be a separately-formed element and can be attached to the main body 146 by any suitable means, such as fasteners, corresponding and interlocking mechanical structures, welding, adhesives, etc.

When the door 120 is moved into the door frame 122, at least a portion of the plates 138 and 139 slide against one another, such that the raised projection 142 is moved into the cut-out 140. The raised projection 142 is thus retained at least partially within the cut-out 140, such that unintended separation of the plates 138, 139 from one another, and thus movement of the door 120 out of the door frame 122, is hindered or altogether prevented.

Further, as depicted at FIG. 4, two first latch plates 138 are coupled to the door 120. Thus, two corresponding second latch plates 139 would be attached to the door frame 122. However, in other embodiments, the door 120 can include a second latch plate 139, while the door frame 122 includes a first latch plate 138 at a location corresponding to that of the second latch plate 139 at the door 120.

In other embodiments, one or more latch mechanisms 130 can be located at alternative and corresponding locations along the hinge side 132 of the door frame 122 and first lateral side 134 of the door 120.

Figure 6:
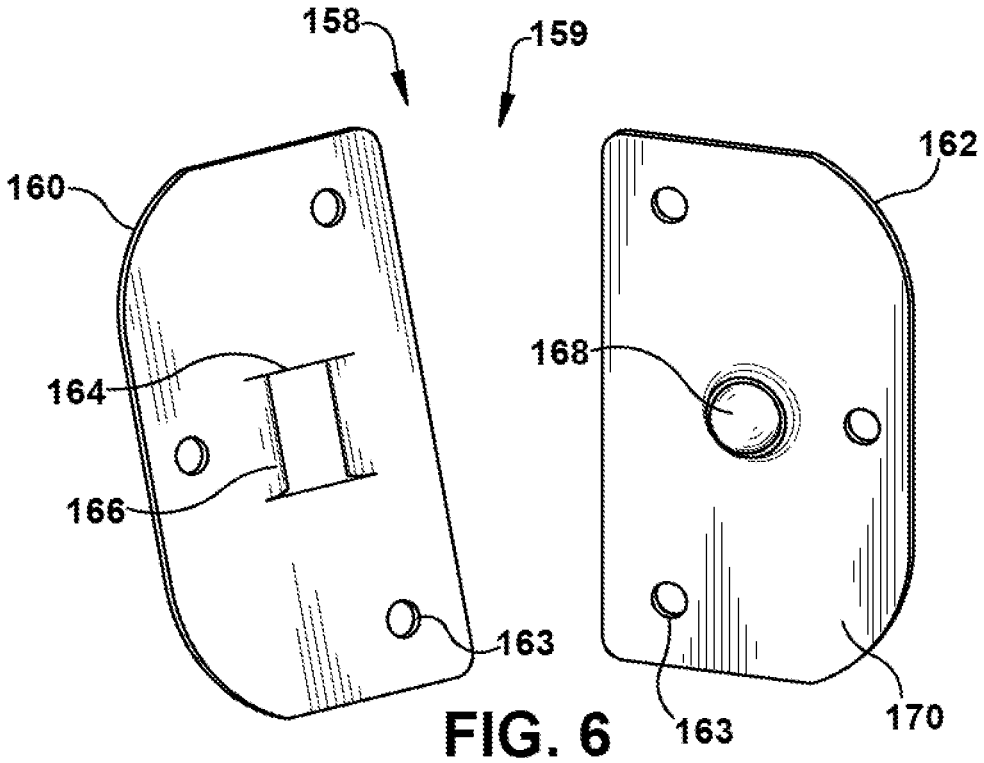
FIG. 6 depicts an alternative pair of corresponding latch plates.

Turning next briefly to FIG. 6, an alternative pair 159 of latch plates 160 and 162 are illustrated side-by-side. These latch plates 160, 162 also have outer peripheries and fastener holes 163 that are similar to one another and that define shapes similar to that of conventional hinge plates. Generally, this latch mechanism 158 includes ball and detent features. The first latch plate 160 includes a cut-out 164 having opposite bent sides 166 being bent towards a bottom side of the latch plate 160, where the bottom side is configured to be disposed against the door frame 122. The bent sides 166 provide opposite rounded edges of the cut-out 164. The second latch plate 162 includes a ball 168 that is retained at, such as being swaged to, the main body 170 of the second latch plate 162.

Accordingly, when the latch plates 160, 162 are respectively coupled to the door 120 and the door frame 122, and the door 120 is moved into the door frame 122, at least a portion of the plates 160 and 162 slide against one another. In this way, the ball 168 is moved into the detent or cut-out 164. The ball 168 is thus retained at least partially within the cut-out 164, such that unintended separation of the plates 160, 162 from one another, and thus movement of the door 120 out of the door frame 122, is hindered or altogether prevented.

Similar to the latch plates 138, 139, in some embodiments, either the door 120 or the door frame 122 can include either of the latch plates 160, 162, with the other of the door 120 and door frame 122 including the other of the latch plates 160, 162. Additionally or alternatively, locations of the latch plates 160, 162 can be correspondingly altered.

Figure 7:
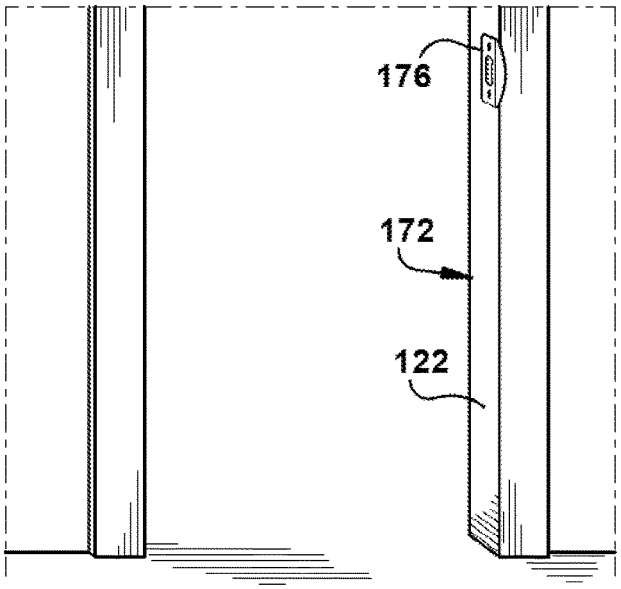
FIG. 7 is another partial perspective view of the door frame of FIG. 2, showing the strike plate coupled to the door jamb.

A latching mechanism 130/158 is one of two aspects allowing for latching of the door 120. The other aspect is the conventional door handle, strike and strike plate. That is, as shown at FIG. 7, a conventional strike plate 176 is coupled to a strike side 172 of the door frame 122. As shown at FIG. 4, the door handle 174 is utilized as the main grasping element of the door 120, for the user to thus be able to move the door 120 relative to the door frame 122, via guiding of the movement mechanism 180, to be described below in detail. As used herein, the door handle 174 can include a knob, a pivotable handle, or other element that is operatable by the user to move the associated strike. The door handle 174 also controls a conventional strike 175 for engaging the strike plate 176.

Accordingly, in some embodiments, the door system 100 can include a door handle, strike, and/or strike plate. However, in situations of conversion of a hinged door to a non-hinged door using the door system 100, the existing door handle, strike, and/or strike plate need not be replaced. Rather, only one or more hinges are replaced by one or more respective latching mechanisms 130.

Further, a deadbolt (not shown) also can assist in latching the door 120, and such deadbolt and respective deadbolt plate need not be removed to convert a hinged door into a non-hinged door with the door system 100.

In addition to coupling the latching mechanisms 130/158 to the door 120, the movement mechanism 180 also is coupled to the door 120, and likewise to the wall 156 having the entry opening 150. The movement mechanism 180 is generally configured to guide the door 120 relative to the entry opening 150 along at least the pair of transverse directions 152 (FIG. 2) and 154 (FIG. 8A). That is, the door 120, via the movement mechanism 180, is able to be slid out of the entry opening 150 and translated along the wall 156 having the entry opening 150. More specifically, the door 120 is able to be translated along the wall 156 with the door 120 aligned generally parallel to the wall 156, and the door 120 is able to be selectively translated into and out of the door frame 122 with the door 120 being aligned generally parallel to the wall 156.

Looking now to FIG. 8A, along with FIG. 7, the movement mechanism 180 includes a support 182, and specifically a primary support element 183 of the support 182, couplable to the door 120. The primary support element 183 can be coupled by any suitable means, such as fasteners, such as screws or bolts, to one face of the door 120. A secondary support element 185 can be included at the opposite face of the door 120, such as to sandwich the door 120 between the primary support element 183 and the secondary support element 185, with these support elements 183, 185 fastened to one another, such as being bolted to one another through the door 120.

The support 182 also generally includes a pair of movable aspects configured to be separately movable relative to the door 120 and relative to one another. A first of these aspects aids movement along the first direction 152 (FIG. 2), while a second of these aspects aids movement along the second direction 154.

For example, the support 182 includes at least one roller 184 (first aspect) coupled relative to the primary support element 183. As depicted a mounting element 186 is coupled relative to the primary support element 183 by an intermediate support rod 188, with the mounting element 186 retaining the roller 184. The roller 184 can include any number of elements, such as bearings and/or discs. The support rod 188 can be selectively extendable to various pre-defined or non-predefined lengths in some embodiments, to allow for fine adjustment of the door 120 when mounted relative to the door frame 122.

The movement mechanism 180 also includes at least one rail 190 along which the roller 184 is guided. The rail 190 can be selectively extendable to various pre-defined or non-predefined lengths in some embodiments. The rail 190 is mounted to the wall 156, vertically above the door frame 122. The length of the rail 190 extends along the full width of the entry opening 150, and also along at least a further distance to one side of the entry opening 150. This further distance is typically at least equal to the width of the door 120. The depicted rail 190 is mounted with a pair of mounting elements 191 coupled to the wall 156, where the mounting elements 191 are disposed at opposite lateral ends of the rail 190. In other embodiments, other suitable mounting means can be utilized.

The mounting element 186 is configured to mount to and to be guided along the rail 190, such that the door 120 is mounted and guided generally parallelly relative to the wall 156 and to the door frame 122. For example, the illustrated mounting element 186 is disposed at least partially about the rail 190, with the roller 184 in rotational engagement with the rail 190. This engagement enables the door 120 to be moved along the first direction 152.

Further, as shown, a pair of supports 182 provide for the mounting of the illustrated door 120, with the supports 182 horizontally spaced apart from one another. In some embodiments, only one support 182 can be used, and in others, additional supports 182 can be used where suitable.

Each support 182 also includes at least one slide 194 (second aspect) that is configured to move the door into and out of the entry opening 150, along the second direction 154 (FIG. 8A). The slide 194 is depicted as a rod and is generally configured to move along a direction of the thickness of the door 120 when coupled to the door 120. The slide 194 can be selectively extendable to various pre-defined or non-predefined lengths in some embodiments. The slide 194 has a proximal end that is fixed to the primary support element 183, and thus the slide 194 is positionable between opposite lateral sides 134, 136 (FIG. 2) of the door 120. A guide element 195 is received about the slide 194. That is, the guide element 195 has a channel in which the guide 194 is received.

Although the slide 194 is depicted as a cylindrical rod, in other embodiments a tube or an alternately shaped tube or rod can be suitable. Alternatively or additionally, it will be appreciated that the primary support element 183, the guide element 195 and the mounting element 186 can have any suitable shape. Likewise, the slide 194 can be a rod, tube, or non-cylindrically shaped rod or tube.

Figure 8B:
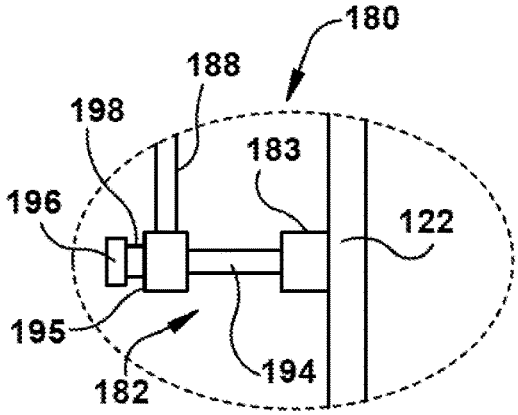
FIG. 8B is a partial side view of the door system as shown in FIG. 8A, with the door having been moved into the respective door frame.

Looking specifically to FIG. 8A, the slide 194 has a distal end movable through the channel in the guide element 195. The distal end can include a stop 196 that is adjustable along the slide 194, such as by a set screw, to set a distant at which the primary support element 183 and the door 120 can extend along the second direction from the guide element 195. This movement is illustrated in FIG. 8B, showing the door 120 having been received into the door frame 122, with the slide 194 having been moved inwardly towards the door frame 122 and the wall 156. The stop 196 likewise is moved in the second direction 154. Alternately, when the door 120 and slide 194 are in the position shown in FIG. 8A, the slide 194 is movable along the rail 190 of the movement mechanism 180 jointly with the door 120, with the slide 194 extending along the second direction 154 outwardly from the entry opening 150.

The support 182, and thus the movement mechanism 180, further can include a biasing element 198 that is configured to bias the door 120 outwardly from the entry opening 150, and thus outwardly from a latched orientation of the door 120 within the door frame 122. The biasing element 198 can be a spring, compressible polymer or foam, or other suitable and biasable structure.

As shown at FIG. 8A, the illustrated biasing element 198 is mounted about the slide 194 and at least partially fixed to the guide element 185. Upon movement of the slide 194 inwardly towards the door frame 122, the stop 196 can come in to contact with the biasing element 198 to thereby bias the door 120 outwardly from the door frame 122. In this way, when a user operates the door handle 174 to open the door 120, the user is assisted in moving the door 120 via the biasing force of the biasing element 198 acting against the stop 196.

Figure 8C:
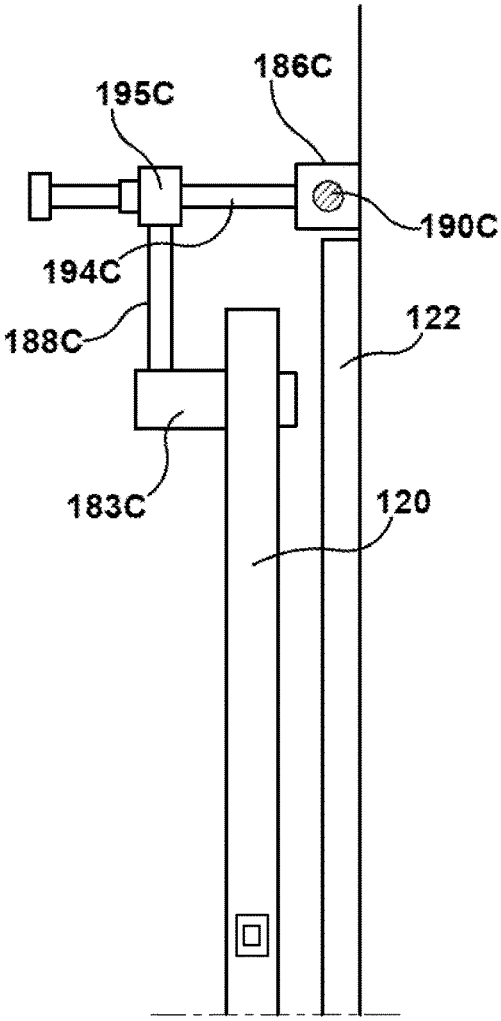
FIG. 8C is a partial side view of an alternative support arrangement for use with the door system as shown in FIG. 8A.

Turning next to FIG. 8C, it also is contemplated that in some embodiments, a slide element 195C could alternatively slide along a slide rod 194C that is instead coupled to, and extends from, a mounting element 186C. For example, FIG. 8C shows an alternate arrangement of the support 182C. That is, the slide element 195C could be fixed in its position relative to the door 120, such that the slide element 195C is coupled to a primary support element 183C by a support rod 188C. In this way, the slide element 195C and door 120 would be jointly movable together along the slide rod 194C and along the second direction 154.

In summary regarding the first embodiment, the door system 100 allows for increased space usage, easy movement of a door 120, and secure latching of the door 120 within the respective door frame 122. A door sweep attached to the door 120 can remain usable, and no unintended gaps remain between the door 120 and door frame 122 when the door 120 is closed.

Further, the door system 100 is compatible with industry standard doors and hinge locations, allowing for conversion of a hinged door into a non-hinged door without modification to the door itself. Rather, alternative aspects of the door system 100 are coupled to the door 120, with the door 120 being alternatively mounted relative to the door frame 122. Likewise, the existing door handle 174, strike 175 and strike plate 176, along with any existing deadbolt, can be retained at the door 120 and door frame 122 without needing to be removed. Instead, these elements still function to aid in latching the door 120 within the door frame 122.

Next, in view of the above description of the structure of the first embodiment and door system 100, a method of converting a hinged door into a non-hinged door will next be described in detail, relative to FIGS. 2 to 7, 8A and 8B.

Accordingly, a method for converting a hinged door into a non-hinged door 120 includes removing the hinged door and removing the hinge plates from each of the door 120 and respective door frame 122. The existing door handle 174 on the door 120 can be retained. A first latch plate (being either one of the plates 138 or 139) of a pair 137 of corresponding latching plates is coupled at a lateral side 134 of the door 120 opposite the existing door handle 174, at a location of the door 120 corresponding to the respective removed hinge plate. A second latch plate (being the other of the plates 138 and 139) of the pair 137 of corresponding latch plates at a location of the door frame 122 corresponding to the respective removed hinge plate. A support 182 of a movement mechanism 180 is coupled to the door 120.

The support 182 is mounted for translation along the door frame 122 along a first direction 152. Particularly, a guide (rail) 190 of the movement mechanism 180 is coupled along a wall 156 having the door frame 122. And the support 182 is mounted onto the guide 190 to thereby hang the door 120 relative to the door frame 122 in a manner such that the door 120 is movable along the guide 190 relative to the door frame 122 along the first direction 152.

The door 120 is moved relative to the door frame 122 by operating the moving mechanism 180 to move the door 120 relative to the guide 190 along a second direction 154 that is transverse to the first direction 152. Particularly, the door 120 is moved along the second direction 154 into the door frame 122, causing slidable engagement of the first latch plate 138 to the second latch plate 139 to thereby latch the door 122 within the door frame 122. The door 120 is moved out of the door frame 122 by operating the door handle 178, causing slidable disengagement of the first latch plate 138 and the second latch plate 139 from one another to thereby withdraw the door 120 from the door frame 122.

Figure 9:
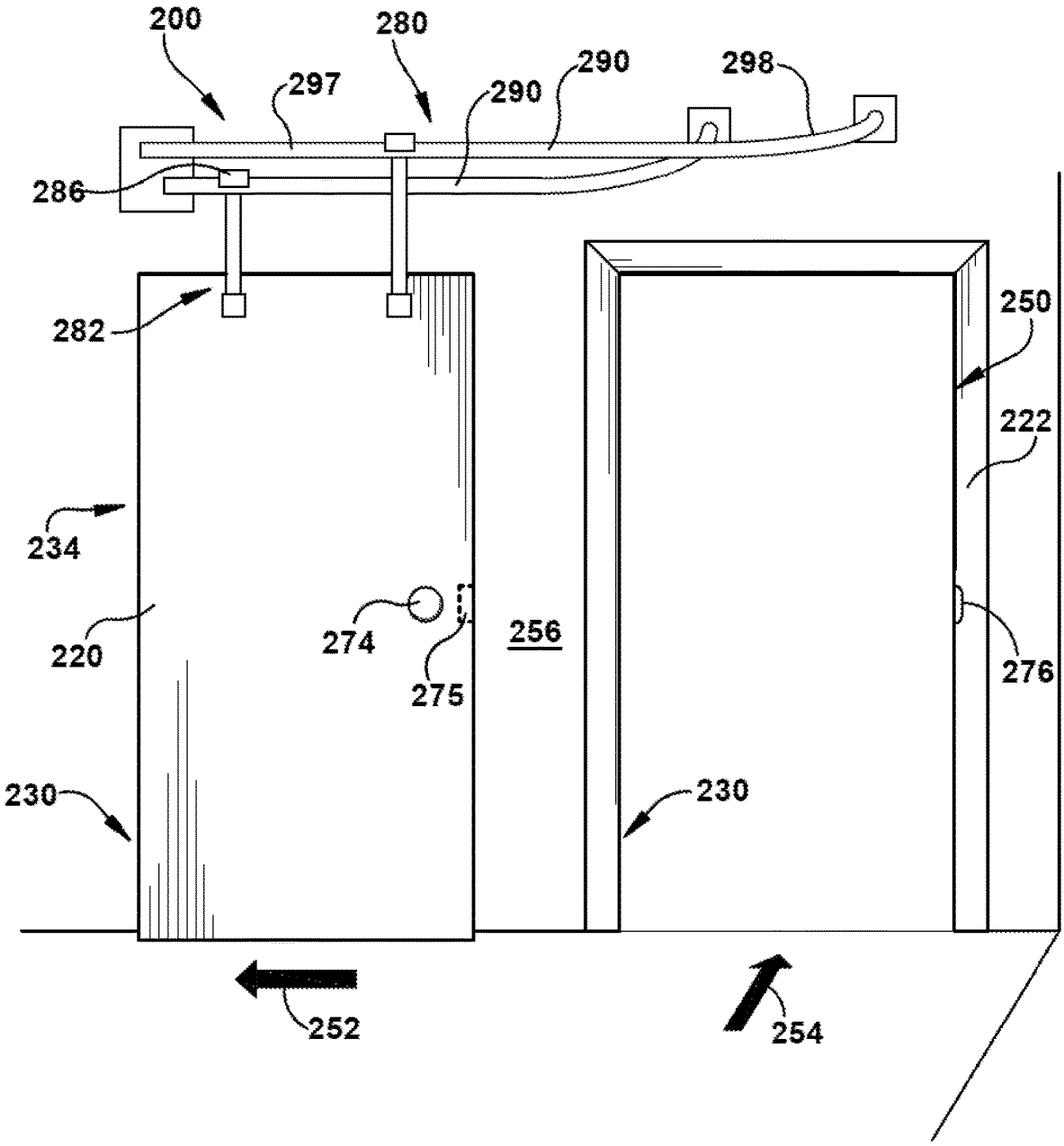
FIG. 9 is a front view of another non-hinged door system according to the subject application, in combination with a conventional door and door frame.

Looking next to FIG. 9, a second embodiment of a door system according to the present disclosure will be described in detail. The door system 200 is substantially similar to the door system 100, except as described below. Elements of this door system 200 that are similar to the door system 100 will be identified by like numbers but offset by 100. Elements of the door system 100 can be used with the door system 200 or vice versa, where suitable.

Generally, the respective movement mechanism 280 includes a pair of supports 282 couplable along the door 220 and a pair of rails 290 couplable along a wall 256 defining the entry opening 250. Each support 282 of the pair of supports is guidable along a different rail 290 of the pair of rails, and the rails 290 are arrangeable vertically separated from one another along the wall 256 defining the entry opening 250.

More specifically, the supports 282 do not require slides, and the support rods 288 extend from the primary support elements 283. This is due to the shape of the rails 290. Differently from the straight rail 190 of the door system 100, the rails 290 include straight sections and curved sections. The straight sections 297 are outwardly spaced from the wall 256 and lead into the curved sections 298. The curved sections 298 curve towards the wall 256, generally along respective planes parallel to one another and to the floor or substratum. The curved section 298 of one rail 290 is horizontally spaced form the curved section of the other rail 290. Additionally, the mounting elements 286 may be rotatable relative to other portions of the supports 282. These structures jointly enable the pair of supports 282 to simultaneously and jointly move together towards the wall 256 along the second direction 254 when closing the door 220, after having translated along the first direction 252. That is, to close the door 220, the supports 282 are guided first along the straight sections 298 and then along the curved sections to bring the door 220 into the door frame 222.

Figure 10:
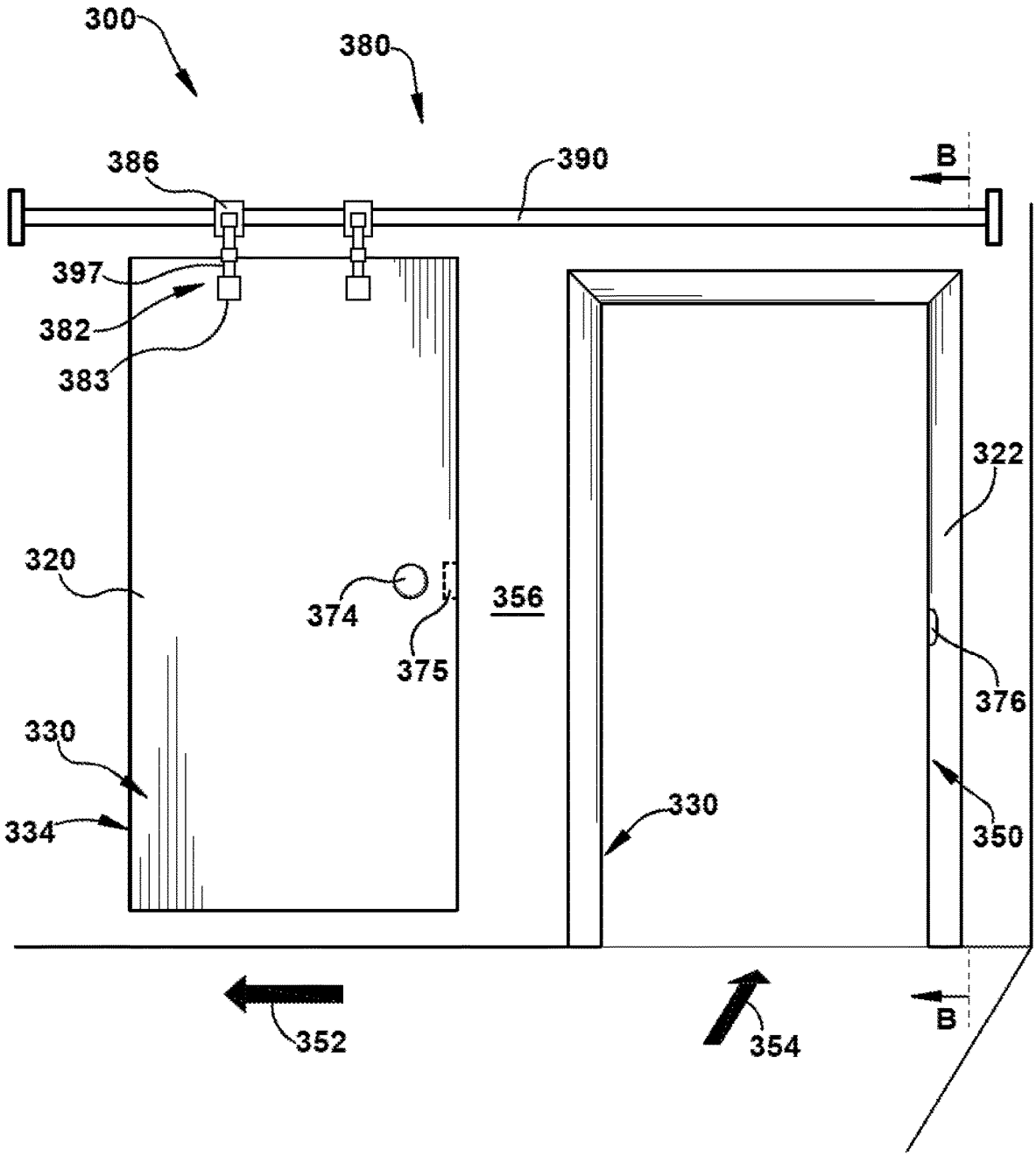
FIG. 10 is a front view of yet another non-hinged door system according to the subject application, in combination with a conventional door and door frame.
Figure 11A:
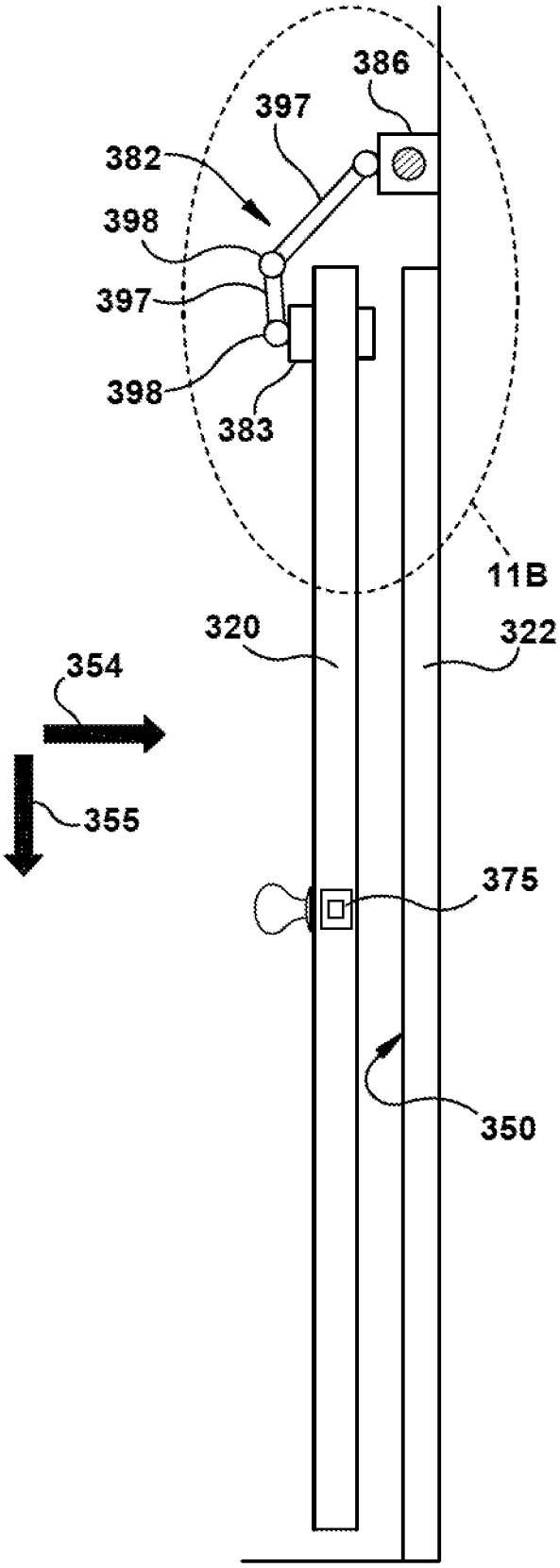
FIG. 11A is a side view of the door system of FIG. 10, shown along the line B-B of FIG. 10.
Figure 11B:
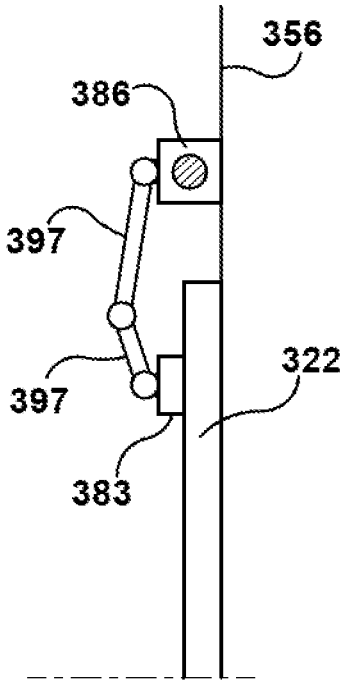
FIG. 11B is a partial side view of the door system as shown in FIG. 11A, with the door having been moved into the respective door frame.

Turning now to FIGS. 10, 11A and 11B, a third embodiment of a door system according to the present disclosure will be described in detail. The door system 300 is substantially similar to the door system 100, except as described below. Elements of this door system 300 that are similar to the door system 100 will be identified by like numbers but offset by 200. Elements of any of the door systems 100, 200 and 300 can be used with one another where suitable.

Generally, the respective movement mechanism 380 includes a support 382 couplable to the door 320. The support 382 includes a pair of movable aspects (pivotable arms 397 and respective roller of the mounting element 386) configured to be separately movable relative to the door 320 and relative to one another. Put another way, the movement mechanism 380 includes a support 382 couplable at the door 320, wherein the support 382 is configured to move the door 320 in one of the two transverse directions 352 and 354, and wherein the support 382 further is configured to move the door 320 in a third direction 355 transverse to each of the two transverse directions 352 and 354.

More specifically, the support 382 includes at least a pair of pivotable arms 397 coupling the mounting element 386 to the primary support element 383. The pivotable arms 397 are coupled to one another and to the mounting element 386 and the primary support element 383 by intermediate rotatable couplings 398 (FIG. 11A) of any suitable shape and structure. In some embodiments, one or more of the rotatable couplings 398 can include a biasing element to bias the door 320 into a position outwardly-spaced from the door frame 322, and also to bias the pivotable arms 397 into an arrangement having a lesser angle between the pivotable arms 397.

That is, as shown specifically at FIGS. 11A and 11B, the support 382 is operable to move the door 320 both vertically downwardly along the third direction 355 (FIG. 11B) and along the thickness direction (second direction 354) of the door 320. Thus, when the latching mechanism 330 and any strike are released, the door 320 can move both outwardly and upwardly relative to the door frame 322, via the pivotable arms 397 of the support 382. Further, as shown at FIG. 10, a pair of supports 382 can be utilized to aid in balancing the door 320 side-to-side.

Additionally, with respect to each of the second and third embodiments, the method described above with respect to the first embodiment, for converting a hinged door into a non-hinged door, is equally applicable to each of the door systems 200 and 300.

In summary, a door system (100, 200, 300) is provided for use with a door (120, 220, 320) and a door frame (122, 222, 322) defining an entry opening (150, 250, 350) to provide selective closing and opening of the entry opening (150, 250, 350). The door system (100, 200, 300) can be used to convert a conventional hinged door into one providing less obtrusion into space in front of and behind the respective entry opening (150, 250, 350). The door system (100, 200, 300) includes an overhead movement mechanism (180, 280, 380) providing at least two transverse directions (152, 154, 252, 254, 352, 354) of movement, and one or more hinge replacement mechanisms (130, 158, 230, 330) providing latching of the door (120, 220, 320) at a lateral side (134, 234, 334) opposite the door handle (174, 274, 374). The movement mechanism (180, 280, 380) is configured to move the door (120, 220, 320) between a closed orientation in the door frame (122, 222, 322) and an open orientation horizontally-spaced from the entry opening (150, 250, 350). The open orientation is disposed along an adjacent wall (156, 256, 356) having the door frame (122, 222, 322). A standard door handle (174, 274, 374), strike (175, 275, 375) and strike plate (176, 276, 376) are used to move and to lock the door (120, 220, 320).

The invention has been described with reference to the example embodiments described above. Modifications and alterations will occur to others upon a reading and understanding of this specification and can be made thereto without departing from the spirit and scope of the invention set forth in the appended claims. Example embodiments incorporating one or more aspects of the invention are intended to include all such modifications and alterations insofar as they come within the scope of the appended claims and their equivalents.

What is claimed is:

1. A door system for use with a door and a door frame defining an entry opening to provide selective closing and opening of the entry opening, the door system comprising:

a movement mechanism couplable to the door for supporting the door relative to the entry opening, the movement mechanism configured to guide the door between a closed orientation where the door is positioned within the entry opening and an open orientation where the door is horizontally spaced from the entry opening, wherein the movement mechanism is further configured to guide the door along at least a pair of transverse directions to move the door out of the entry opening and to translate the door along a wall having the entry opening;

a latching mechanism retaining the door within the entry opening, wherein the latching mechanism is couplable to the door frame and to a first lateral side of the door, wherein the latching mechanism is configured to stabilize the door within the entry opening against further movement along the pair of transverse directions, and the latching mechanism comprising a pair of corresponding latch plates, wherein a first plate of the pair of corresponding latch plates is configured to be coupled to a first lateral side of the door, and a second plate of the pair of corresponding latch plates is configured to be coupled to the door frame, and a handle element used to move and lock the door, the handle element comprising a strike plate coupled to the door frame and a strike coupled to a second lateral side of the door.

2. The door system of claim 1, wherein the movement mechanism includes at least one roller and one rail along which the roller is guided.

3. The door system of claim 1, wherein the movement mechanism includes at least one slide that is configured to extend along a direction of a thickness of the door when coupled to the door, and wherein the slide is positionable between opposite lateral sides of the door.

4. The door system of claim 3, wherein the at least one slide is movable along a rail of the movement mechanism.

5. The door system of claim 1, wherein the movement mechanism includes a biasing element that is configured to bias the door outwardly from the entry opening.

6. The door system of claim 1, in combination with the door and the door frame, and the movement mechanism further including at least one slide extending in a direction outwardly from the entry opening, wherein the slide is configured to move the door into and out of the entry opening.

7. The door system of claim 1, wherein the second plate of the pair of corresponding latch plates is configured to replace a portion of a hinge.

8. The door system of claim 1, wherein the pair of corresponding latch plates are configured to slidably engage and to couple to one another.

9. The door system of claim 1, wherein the movement mechanism includes a pair of supports couplable along the door and a pair of rails couplable along the wall having the entry opening, wherein each support of the pair of supports is guidable along a different rail of the pair of rails, and wherein the pair of rails are arrangeable vertically-separated from one another along the wall having the entry opening.

10. The door system of claim 1, wherein the movement mechanism includes a support couplable at the door, wherein the support is configured to move the door in one of the pair of transverse directions, and wherein the support further is configured to move the door in a third direction transverse to each of the pair of transverse directions.

11. The door system of claim 1, wherein the movement mechanism includes a support couplable to the door, wherein the support includes a pair of movable aspects configured to be separately movable relative to the door and relative to one another.

12. A door conversion system for converting a hinged door into a non-hinged door, the door conversion system comprising:

a movement mechanism providing at least two transverse directions of movement and couplable at a door to-be-converted;

a hinge replacement mechanism coupled to a first lateral side of the door, the hinge replacement mechanism including a pair of corresponding plates, wherein a first plate of the pair of corresponding plates is configured to be coupled to the first lateral side of the door and a second plate of the pair of corresponding plates is configured to be coupled to a door frame, the first lateral side of the door being opposite a second lateral side of the door, the hinge replacement mechanism configured to latch the first lateral side of the door within the door frame; and a door handle element located adjacent to the second lateral side of the door configured to move and lock the door, the door handle element comprising a strike plate coupled to the door frame and a strike coupled to a second lateral side of the door;

wherein the movement mechanism is configured to couple to a wall having the door frame, wherein the movement mechanism is configured to enable selective translation of the door into and out of the door frame with the door being aligned parallel to the wall having the door frame, and wherein the movement mechanism further is configured to enable selective translation of the door along the wall having the door frame while retaining the door aligned parallel to said wall.

13. The door conversion system of claim 12, wherein the pair of corresponding plates are configured to slidably engage and to couple to one another.

14. The door conversion system of claim 12, wherein the movement mechanism includes a support couplable to the door, wherein the support includes a pair of movable aspects configured to be separately movable relative to the door and relative to one another.

* * * * *